US009240270B2

(12) United States Patent
Wu et al.

(10) Patent No.: US 9,240,270 B2
(45) Date of Patent: Jan. 19, 2016

(54) WIRELESS POWER TRANSFER MAGNETIC COUPLERS

(71) Applicant: Utah State University Research Foundation, North Logan, UT (US)

(72) Inventors: Hunter Wu, Logan, UT (US); Aaron Gilchrist, Logan, UT (US); Kylee Sealy, Logan, UT (US)

(73) Assignee: Utah State University, North Logan, UT (US)

( * ) Notice: Subject to any disclaimer, the term of this patent is extended or adjusted under 35 U.S.C. 154(b) by 475 days.

(21) Appl. No.: 13/648,201

(22) Filed: Oct. 9, 2012

(65) Prior Publication Data

US 2013/0088090 A1 Apr. 11, 2013

Related U.S. Application Data

(60) Provisional application No. 61/544,957, filed on Oct. 7, 2011.

(51) Int. Cl.

| | |
|---|---|
| ***H01F 27/00*** | (2006.01) |
| ***H01F 3/08*** | (2006.01) |
| ***H01F 38/14*** | (2006.01) |
| *H01F 27/255* | (2006.01) |
| *H01F 27/36* | (2006.01) |

(52) U.S. Cl.

CPC ..... *H01F 27/00* (2013.01); *H01F 3/08* (2013.01); *H01F 38/14* (2013.01); *H01F 27/255* (2013.01); *H01F 27/36* (2013.01)

(58) Field of Classification Search

USPC ..... 336/92; 307/104

See application file for complete search history.

(56) References Cited

U.S. PATENT DOCUMENTS

| | | | | |
|---|---|---|---|---|
| 4,661,897 | A | 4/1987 | Pitel et al. | |
| 4,908,347 | A * | 3/1990 | Denk | 505/166 |
| 6,317,338 | B1 | 11/2001 | Boys | |
| 6,366,051 | B1 | 4/2002 | Nantz et al. | |
| 6,448,745 | B1 | 9/2002 | Killat et al. | |
| 7,148,669 | B2 | 12/2006 | Maksimovic et al. | |
| 7,652,459 | B2 | 1/2010 | Qahouq et al. | |
| 8,085,024 | B2 | 12/2011 | Prodic et al. | |

(Continued)

FOREIGN PATENT DOCUMENTS

| | | |
|---|---|---|
| EP | 1717940 A2 | 2/2006 |
| FR | 2738417 A1 | 3/1997 |

(Continued)

OTHER PUBLICATIONS

Magnus et al., "A d.c. magnetic metamaterial", vol. 7, Nature Materials by Nature Publishing Group, pp. 295-297 (Apr. 2008).*

(Continued)

*Primary Examiner* — Jared Fureman
*Assistant Examiner* — James P Evans
(74) *Attorney, Agent, or Firm* — Kunzler Law Group

(57) ABSTRACT

A magnetic coupler is disclosed for wireless power transfer systems. A ferrimagnetic component is capable of guiding a magnetic field. A wire coil is wrapped around at least a portion of the ferrimagnetic component. A screen is capable of blocking leakage magnetic fields. The screen may be positioned to cover at least one side of the ferrimagnetic component and the coil. A distance across the screen may be at least six times an air gap distance between the ferrimagnetic component and a receiving magnetic coupler.

10 Claims, 17 Drawing Sheets

(56) References Cited

U.S. PATENT DOCUMENTS

| | | | | |
|---|---|---|---|---|
| 2006/0181906 | A1 | 8/2006 | Batarseh et al. | |
| 2008/0203992 | A1 | 8/2008 | Qahouq et al. | |
| 2009/0174263 | A1 | 7/2009 | Baarman et al. | |
| 2009/0267582 | A1 | 10/2009 | Prodic et al. | |
| 2010/0109604 | A1 | 5/2010 | Boys et al. | |
| 2010/0134215 | A1 | 6/2010 | Lee et al. | |
| 2010/0231340 | A1* | 9/2010 | Fiorello et al. | 336/92 |
| 2011/0049978 | A1 | 3/2011 | Sasaki et al. | |
| 2011/0163542 | A1 | 7/2011 | Farkas | |
| 2011/0181240 | A1 | 7/2011 | Baarman et al. | |
| 2011/0304216 | A1 | 12/2011 | Baarman | |
| 2012/0049620 | A1 | 3/2012 | Jansen | |
| 2012/0112552 | A1* | 5/2012 | Baarman et al. | 307/104 |
| 2013/0049484 | A1 | 2/2013 | Weissentern et al. | |

FOREIGN PATENT DOCUMENTS

| | | | |
|---|---|---|---|
| RU | 2412514 | C2 | 2/2011 |
| TW | 200810315 | A | 2/2008 |
| WO | 2012001291 | A2 | 1/2012 |
| WO | 2012007942 | A2 | 1/2012 |

OTHER PUBLICATIONS

Brooker et al., Technology improvement pathways to cost effective vehicle electrification, 2010 SAE2010 World Cong. 1-18 (Feb. 1, 2010).
Budhia et al., Design and Optimisation of Circular Magnetic Structures for Lumped Inductive Power Transfer Systems, 2009 Energy Conversion Cong. and Expo 2081-2088 (Sep. 20-24, 2009).
Magnus et al., A d.c. magnetic metamaterial, 7:4 Nat. Mater. 295-297 (2008).
Milton et al., Realizability of metamaterials with prescribed electric permittivity and magnetic permeability tensors, 12 New Journal of Physics (Mar. 2010).
Zierhofer et al., Geometric approach for coupling enhancement of magnetically coupled coils, 43 IEEE Transactions on Biomedical Engineering 708-714 (1996).
Boys et al., Stability and control for inductively coupled power transfer systems, 147 IEE Proc.—Electric Power Applications 37-43 (2000).
Wu et al., A 1kW inductive charging system using AC processing pickups, 6 IEEE Industrial Electronics and Applications 1999-2004 (Jun. 21-23, 2011).
Covic et al., A Three-Phase Inductive Power Transfer System for Roadway-Powered Vehicles, 54:6 IEEE Transactions on Industrial Applications 3370-3378 (2007).
Borage et al., Analysis and design of an LCL-T resonant converter as a constant-current power supply, 52 IEEE Transactions on Industrial Electronics 1547-1554 (2005).
Wu et al., Design of Symmetric Voltage Cancellation Control for LCL converters in Inductive Power Transfer Systems, 2011 IEEE International Electric Machines & Drives Conf. 866-871 (May 15-18, 2011).
Nakao et al., Ferrite core couplers for inductive chargers, 2 Power Conversion Conf. 850-854 (2002).
Wu et al., A review on inductive charging for electric vehicles, 2011 IEEE Int'l Macnines & Drives Conf. 143-147 (May 15-18, 2011).
Huang et al., LCL pick-up circulating current controller for inductive power transfer systems, 2010 IEEE Energy Conversion Cong. and Exposition (ECCE) 640-646 (Sep. 12-16, 2010).
Budhia et al., A new IPT magnetic coupler for electric vehicle charging systems 36 IEEE Industrial Electronics and Applications 2487-2492 (Nov. 7-10, 2010).
Budhia et al., Development and evaluation of single sided flux couplers for contactless electric vehicle charging, 2011 IEEE Energy Conversion Cong. and Expo 613-621 (Sep. 17-22, 2011).
Chigira et al., Small-Size Light-Weight Transformer with New Core Structure for Contactless Electric Vehicle Power Transfer System, 2011 IEEE Energy Conversion Cong. and Expo 260-266 (Sep. 17-22, 2011).
Jin et al., Characterization of novel Inductive Power Transfer Systems for On-Line Electric Vehicles, 26 IEEE Applied Power Electronics Conference and Expo 1975-1979 (Mar. 6-11, 2011).
Nagatsuka et al., Compact contactless power transfer system for electric vehicles, 2010 Int'l Power Electronics Conf. 807-813 (Jun. 21-24, 2010).
Covic et al., Self tuning pick-ups for inductive power transfer, 2008 IEEE Power Electronics Specialists Conf. 3489-3494.
Si et al., Wireless Power Supply for Implantable Biomedical Device Based on Primary Input Voltage Regulation, 2 IEEE Cof. on Industrial Electronics and Applications 235-239 (2007).
Joung et al., An energy transmission system for an artificial heart using leakage inductance compensation of transcutaneous transformer, 13 IEEE Transactions on Power Electronics 1013-1022 (1998).
Si et al., A Frequency Control Method for Regulating Wireless Power to Implantable Devices, 2 IEEE Transactions on Biomedical Circuits and Systems 22-29 (2008).
Sasaki et al., Thermal and Structural Simulation Techniques for Estimating Fatigue of an IGBT Module, 20 Power Semiconductor Devices and IC's 181-184 (2008).
Ciappa et al., Lifetime prediction of IGBT modules for traction applications, 38 IEEE Reliability Physics Symp. 210-216 (2000).
Borage et al., Analysis and design of an LCL-T resonant converter as a constant-current power supply, 52 IEEE Int'l Electric Machines & Drives Conf. 1547-1554 (2005).
Budhia et al., A new IPT magnetic coupler for electric vehicle charging systems, 36 IEEE Industrial Electronics Conf. 2487-2492 (Nov. 10-17, 2010).
Keeling et al., A Unity-Power-Factor IPT Pickup for High-Power Applications, 57 IEEE Transactions on Industrial Electronics 744-751 (Feb. 2010).
Boys et al., Single-phase unity power-factor inductive power transfer system, 2008 IEEE Power Electronics Specialists Conf. 3701-3706.
Xu et al., Modeling and controller design of ICPT pickups, 3 Int'l Conf. on Power System Technology 1602-1606 (2002).
Si et al., Analyses of DC Inductance Used in ICPT Power Pick-Ups for Maximum Power Transfer, 2005 IEEE Transmission and Distribution Conf. and Exhibition: Asia and Pacific 1-6 (2005).
Boys et al., Controlling inrush currents in inductively coupled power systems, 7 IEEE Int'l Power Engineering Conference 1046-1051 (2005).
Musavi et al., A High-Performance Single-Phase Bridgeless Interleaved PFC Converter for Plug-in Hybrid Electric Vehicle Battery Chargers, 47 IEEE Transactions on Industry Applications 1833-1843 (Jul.-Aug. 2011).
Elliott et al., Multiphase Pickups for Large Lateral Tolerance Contactless Power-Transfer Systems, 57 IEEE Transactions on Industrial Electronics 1590-1598 (May 2010).
Wang et al., Design considerations for a contactless electric vehicle batter charger, 52 IEEE Transactions on Industrial Electronics 1308-1314 (2005).
Schurig, D. et al., "Electric-field-coupled resonators for negative permittivity metamaterials," Appl. Phys. Lett. 88, 041109(2006).

* cited by examiner

WIRELESS POWER TRANSFER MAGNETIC COUPLERS

CROSS-REFERENCE TO RELATED APPLICATIONS

This application claims priority to U.S. Provisional Application No. 61/544,957, filed Oct. 7, 2011, the entirety of which is incorporated herein by reference.

GOVERNMENT SPONSORED RESEARCH

This invention was made, at least in part, with government support under contract DE-EE0003114 awarded by the Department of Energy. The government has certain rights in the invention

TECHNICAL FIELD

The present disclosure relates to magnetics pad designs for inductive power transfer systems, and in particular, to using both ferrimagnetic and diamagnetic materials to improve coupling coefficient. This can allow inductive power transfer system to be used as a coupler to power electric vehicles (EV) using electrified roadway systems.

BACKGROUND

One method of realizing wireless power transfer is through a process known as Inductive Power Transfer (IPT) in which input power, in the form of electrical energy from a constant high frequency alternating current, is transformed into time varying magnetic fields according to Ampere's Law. On the receiving end, the magnetic field is transformed into an induced voltage according to Faraday's Law, thus creating output power for the load. The basic IPT process is illustrated in FIG. 1. Wireless power transfer may enable electric vehicles, or other electrical devices, to be continuously charged while stationary or charged in-motion with no physical connection between the vehicle/device and the roadway/power source.

Recently, some proponents assert that there are enough significant technical advances in IPT that the whole roadway system in the US could be retrofitted by IPT infrastructure to power EV's as they drive on the road. In such a system, the EV performance could be greatly improved by 1) reducing the battery cost, 2) reducing on-board battery weight and size, 3) potentially a cost effective infrastructure system. A. Brooker et al., "Technology improvement pathways to cost effective vehicle electrification," in *SAE*2010 *World Congress*, Detroit, Mich., 2010.

IPT systems can be broadly separated into three main component groups, including the power supply, magnetic coupler, and the pickup receiver. However, prior to broad-based implementation of such systems, IPT systems and associated components must be further improved.

SUMMARY

The present disclosure in aspects and embodiments addresses these various needs and problems by providing an improved magnetic coupler (also referred to as "pad"). The magnetic coupler comprises a ferrimagnetic component, a coil, and a screen. The improved pad is designed to perform in stationary and in-motion IPT systems and results in an improved coupling coefficient while also maintaining a relatively small changing coupling coefficient with respect to the direction of vehicle movement.

BRIEF DESCRIPTION OF THE DRAWINGS

FIG. 3(*b*) illustrates an exemplary magnetic circuit for the magnetic coupler illustrated in FIG. 3(*a*).

FIG. 5(*b*) illustrates another element of an exemplary screen. The insertion of layers of elements illustrated in 5(*a*) between the layers depicted in 5(*b*) may comprise an exemplary laminate structure for an exemplary screen.

FIG. 6(*b*) illustrates an exemplary magnetic circuit for the magnetic coupler illustrated in FIG. 6(*a*).

DETAILED DESCRIPTION

Figure 1:
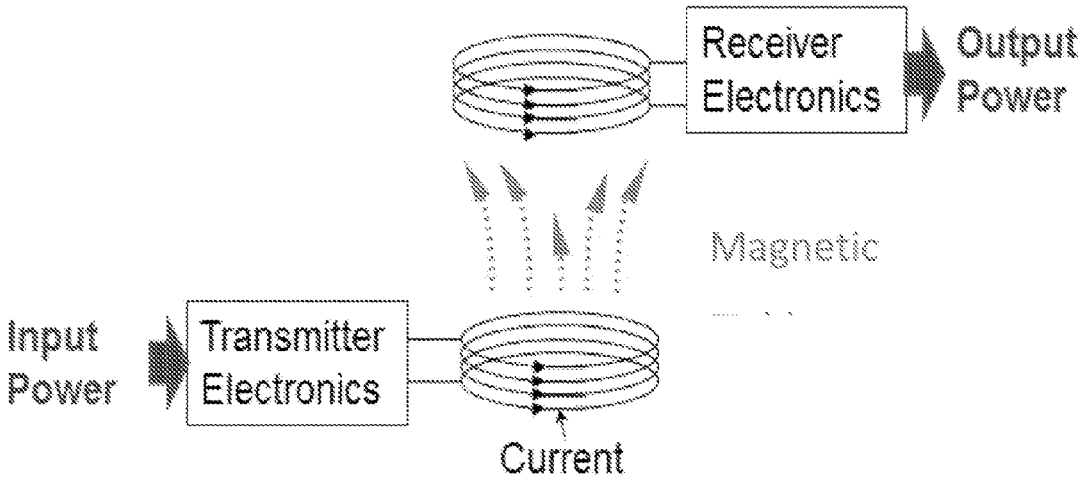
Figure 1 (Prior Art)
FIG. 1 illustrates power flow diagram of inductive power transfer.

The present disclosure covers apparatuses and associated methods for an improved IPT pad. In the following description, numerous specific details are provided for a thorough understanding of specific preferred embodiments. However, those skilled in the art will recognize that embodiments can be practiced without one or more of the specific details, or with other methods, components, materials, etc. In some cases, well-known structures, materials, or operations are not shown or described in detail in order to avoid obscuring aspects of the preferred embodiments. Furthermore, the described features, structures, or characteristics may be combined in any suitable manner in a variety of alternative embodiments. Thus, the following more detailed description of the embodiments of the present invention, as illustrated in some aspects in the drawings, is not intended to limit the scope of the invention, but is merely representative of the various embodiments of the invention.

In this specification and the claims that follow, singular forms such as "a," "an," and "the" include plural forms unless the content clearly dictates otherwise. All ranges disclosed herein include, unless specifically indicated, all endpoints and intermediate values. In addition, "optional" or "optionally" refer, for example, to instances in which subsequently described circumstance may or may not occur, and include instances in which the circumstance occurs and instances in which the circumstance does not occur. The terms "one or more" and "at least one" refer, for example, to instances in which one of the subsequently described circumstances occurs, and to instances in which more than one of the subsequently described circumstances occurs.

Figure 2:
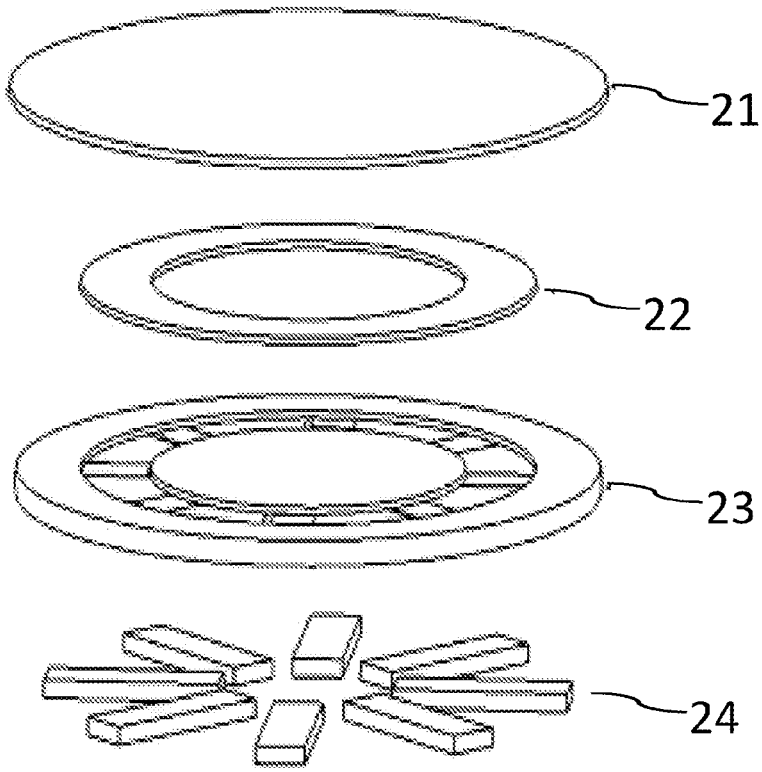
Figure 2 (Prior Art)
FIG. 2 illustrates an exploded view of a circular magnetic coupler.

In some IPT applications, a circular magnetic coupler may be used. Budhia et al., "Design and Optimisation of Circular Magnetic Structures for Lumped Inductive Power Transfer Systems" Energy Conversion Congress and Exposition, 2009. ECCE 2009 pp. 2081-2088 IEEE, 2009. FIG. 2 illustrates an exploded view of such a coupler and its components. These include ferrites arranged in a fanning pattern 24, a coil former 23 that lies on top of the ferrites 24, a coil 22 that lies inside of the coil former 23, and a plastic cover 21 to seal the unit together. In such a pad, it is also well known that a null occurs in the coupling and thus power profile at a horizontal offset in pads of around 30-50% of the pad diameter. This null requires extra margin in a design by precise operational alignment (often completely infeasible for applications), larger pad diameters, or overrated compensating electronic circuitry.

Figure 3:
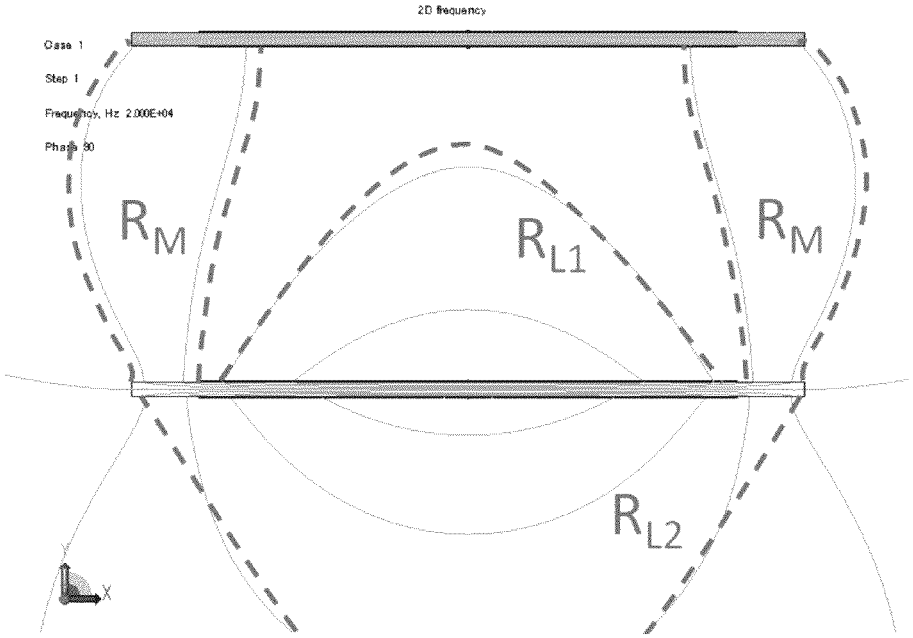
FIG. 3(*a*) illustrates exemplary flux paths, including the reluctance paths and leakage inductances for an exemplary magnetic coupler.
Figure 3:
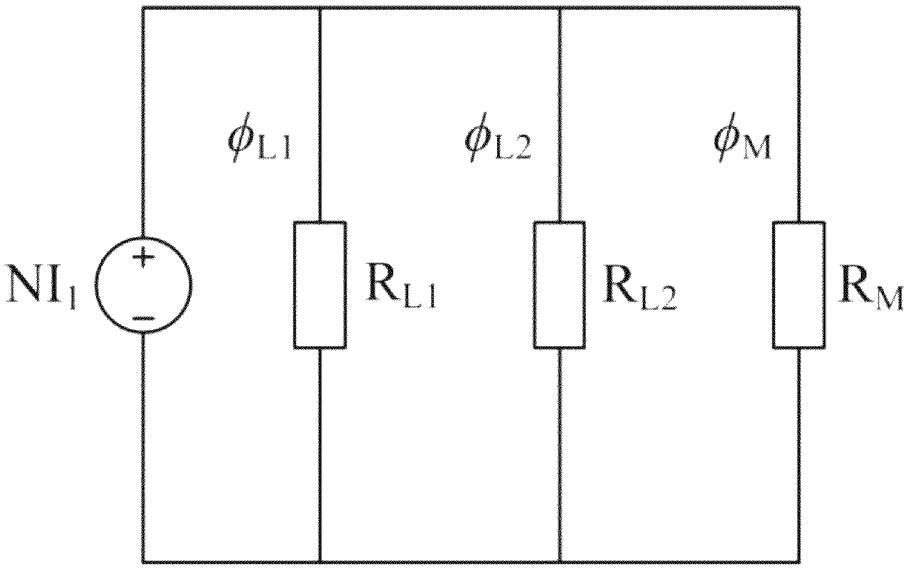

A system employing such transmitting pad is illustrated in FIG. 3(*a*). In particular, FIG. 3(*a*) illustrates the ferrimagnetic material guiding the flux path. The flux path of this pickup can be classified into different reluctance paths corresponding to their mutual and leakage inductances as $R_M$, $R_{L1}$, and $R_{L2}$. An approximate magnetic circuit for this particular pad is shown in 3(*b*).

If the loosely coupled transformer is assumed with a turns ratio of 1:1, then using T-equivalent circuit of transformers, the coupling coefficient may be expressed as:

$$k = \frac{M}{L_{L1} + M} \quad \text{(Formula 1)}$$

Where k is the coupling coefficient, M is the mutual inductance and $L_{L1}$ is the primary leakage inductance. From conventional definition, the inductances of the transformer are given by:

$$M = \frac{N^2}{R_M},\ L_{L1} = \frac{N^2}{R_{L3} \| R_{L2}} \quad \text{(Formula 2)}$$

where N is the number of turns, $R_M$ is the reluctance for the mutual inductance, and $R_{L1}$ and $R_{L2}$ are the reluctance for the leakage inductance. Substituting Formula 2 into Formula 1 will result in the following:

$$k = \frac{1}{R_M / R_{L1} \| R_{L2} + 1} \quad \text{(Formula 3)}$$

Thus, from a mathematical perspective, increasing the magnetic reluctance of the flux path for leakage inductances may result in an improved coupling coefficient.

Figure 4:
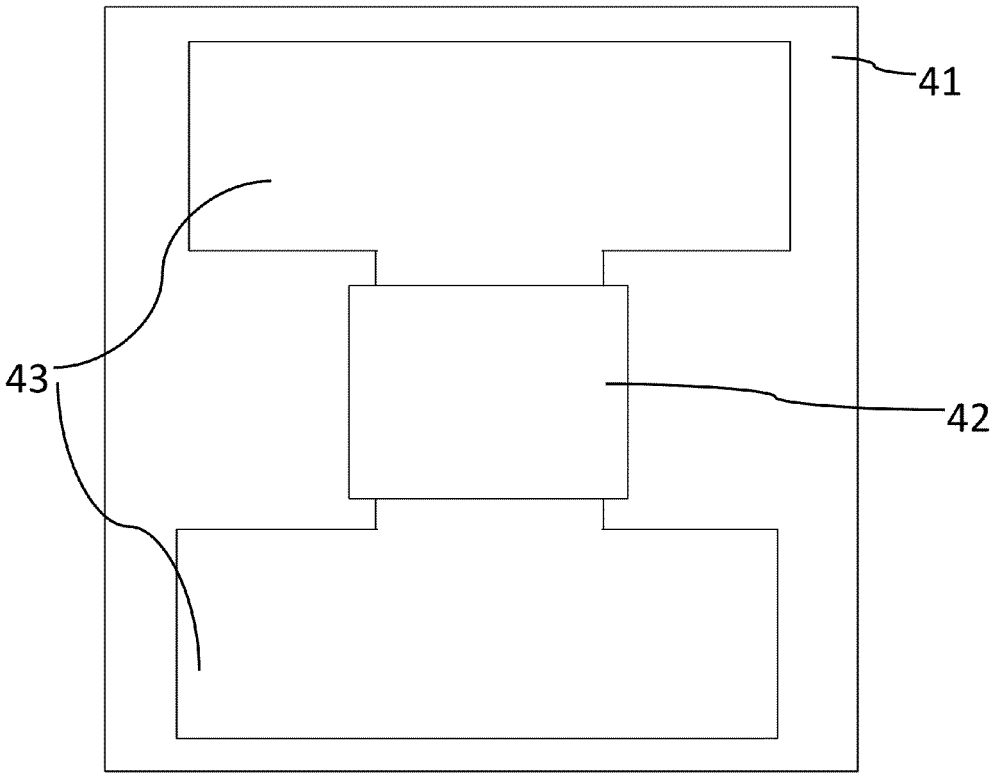
FIG. 4 illustrates an exemplary magnetic coupler.

The instant disclosure provides both apparatuses and methods for improving the coupling coefficient by adopting the concept of guiding magnetic fields via soft ferrimagnetic materials like ferrite and also blocking unwanted leakage fields using materials that behave as diamagnetic materials. Thus, the magnetic coupler includes a ferrimagnetic component, a coil, and a paramagnetic screen. An exemplary pad is illustrated in FIG. 4 and described below.

Ferrimagnetic Component.

The ferrimagnetic component 43 may include any material capable of guiding a magnetic field. Exemplary ferrimagnetic materials include, for example, ferrites, soft ferrites, and soft ferrites containing iron, nickel, zinc, and/or manganese. Exemplary soft ferrites include, but are not limited to, manganese-zinc ferrite and nickel-zinc ferrite. Variations in the structure of the ferrimagnetic materials may also be employed, for example, fully sintered, substantially sintered, powder ferrite, and nanocrystalline grown structures may be used. The ferrimagnetic component 43 may be configured so as to generate a horizontal field and may be configured into any suitable shape capable of generating such a field and/or appropriately guiding the magnetic field. In some embodiments, the ferrimagnetic component 43 is an H-shape.

Coil.

The coil 42 may be constructed from any material that can carry alternating current, for example, litz wire. Any suitable litz wire may be used with suitable amps rating depending on the desired output, for example, litz wire with an amp rating of from 1 amp or more, such as 1 amp to 100 amps, 3 amps to 20 amps, or 5 amps to 15 amps may be used. The coil is created by wrapping the wire around a portion or the entire ferrimagnetic component. For example, litz wire may be wrapped around a portion of a ferrite component, as is illustrated in FIG. 4. When an H-shaped ferrimagnetic component 43 is used, the coil 42 may be wrapped/positioned, or substantially positioned in center area of the H, as illustrated in FIG. 4.

Screen.

A screen 41 is included in the magnetic coupler to block and/or repel unwanted leakage fields. The screen 41 may be composed of any material or combination of material capable of blocking the leakage fields. For example, diamagnetic materials may be used as screens or as components of screens. Such materials may include specially structured conductive materials, designs based on superconductors (see, e.g., Magnus et al., "A D.C. magnetic metamaterial," Nat Mater 7 (4), 295-297 (2008)), metamaterials, superconductive metamaterials, actively excited circuits, and partly diamagnetic materials such as bismuth, mercury, copper and carbon, or combinations thereof. Suitable metamaterials may include in their composition PCB coils, Litz wire, and low-loss PCB dielectrics as outlined in Example 2.

Figure 5A:
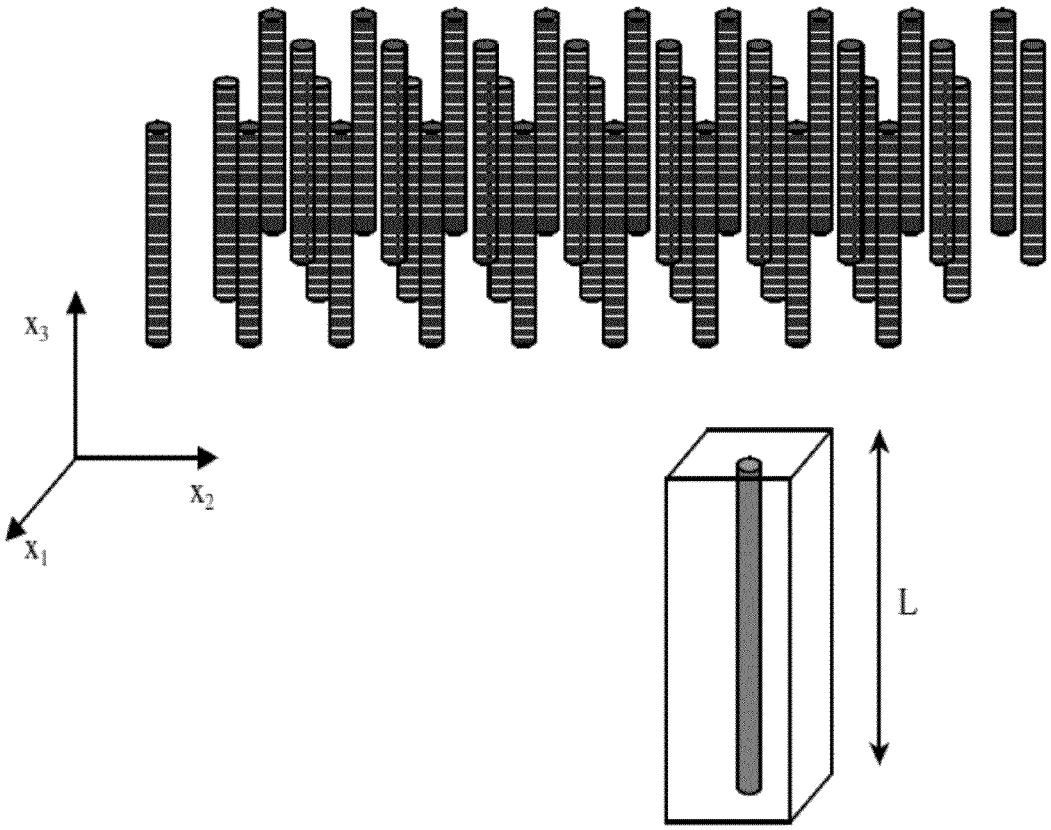
FIG. 5(*a*) illustrates an element of an exemplary screen.
Figure 5B:
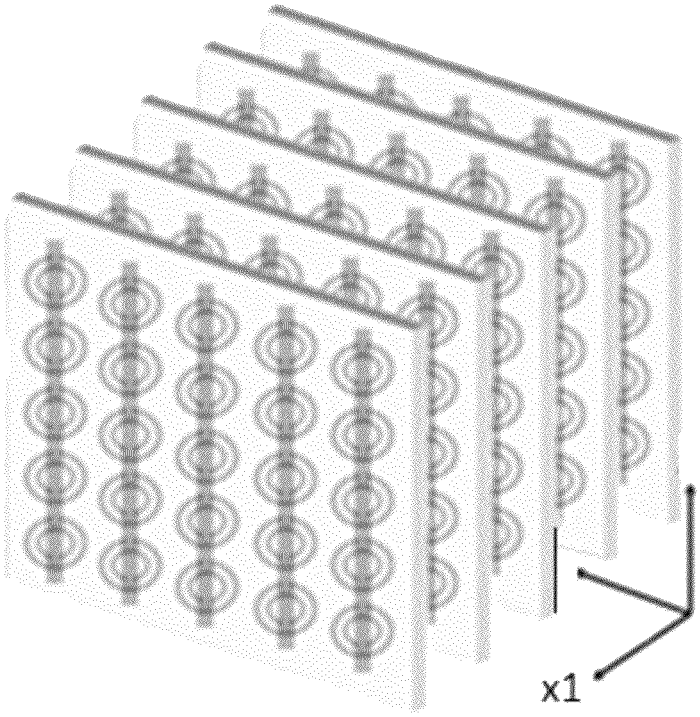

Another exemplary screen material is illustrated in FIG. 5. In FIG. 5(*a*) a structured array of electrical conductors such as copper, aluminum, carbon or others in a non-conducting or semiconducting medium is depicted. The length of an individual conductor and its diameter along with the spacing between conductors are selectable parameters. In FIG. 5(*b*), highly conducting split-ring resonators arranged in a periodic lattice with axes aligned in the x1-direction, and one split-ring per unit cell are shown. The split rings are also constructed of electrical conductors such as copper, aluminum, carbon or others and may be braided into Litz structure or the normal bundled wire. The split rings may contain an electrically non-conducting or semiconducting medium.

The screen 41 may be configured to cover all or substantially all of the ferrimagnetic component 43 and coil 42. Such a covering may be selectively positioned on one or both of the top or bottom of the ferrimagnetic component 43 and coil 42. In embodiments, a single screen 41 may be positioned on a single side of the ferrimagnetic component 43 and coil 42 so that the leakage is blocked on a single side but the magnetic field is permitted to flow outward. This outward flow facilitates the flow between a pair of magnetic couplers, thus permitting for a more efficient wireless power transfer.

The principle of an artificial diamagnetic material is fundamentally governed by solutions to Maxwell's equations and quantum mechanics considerations governing the magnetic moments in materials, where objects placed in the time varying magnetic field can induce internal eddy currents that will produce equal and opposite magnetic fields against the original magnetic field, hence blocking the intended path of the original magnetic field. Due to this eddy current flowing in a circular loop in the effective diamagnetic material, associated conduction losses are probable. These losses would directly reduce the unloaded quality factor (Q) of the pad inductor, hence reducing pad efficiency. Although there is reduction of Q in the pad, the reduced primary track current via the increased coupling result in efficiency improvements for a practical system (i.e. the loss reductions due to decreases in circulation currents far outweigh the increase in Q). However, to improve efficiency, it is necessary to also manipulate the dimension and structure of these effective diamagnetic field screens such that their internal losses can be minimized.

An exemplary approach to the structure is shown in FIG. 5. The structure is a laminate composite made up of varying and/or alternating metamaterials referred to as α and β. Material α could consist of a cubic lattice of well-separated cubes, where each cube has a microstructure of highly conducting rods aligned in the x1-direction. Material β could have highly conducting split-ring resonators arranged in a periodic lattice with axes aligned in the x1-direction, and one split-ring per unit cell. The split rings behave like polarizable magnetic dipoles, and if one is just above resonance these can have negative permeability in the x1-direction. By manipulating dimensions and spacing of these building blocks and laminations it has been shown that almost any permeability and permittivity combination can be engineered, including the low loss one for the parameters of operation of the inductive power transfer system. Graeme W Milton, "Realizability of metamaterials with prescribed electric permittivity and magnetic permeability tensors", New Journal of Physics 12 033035 (11 pp), 2010.

Figure 6A:
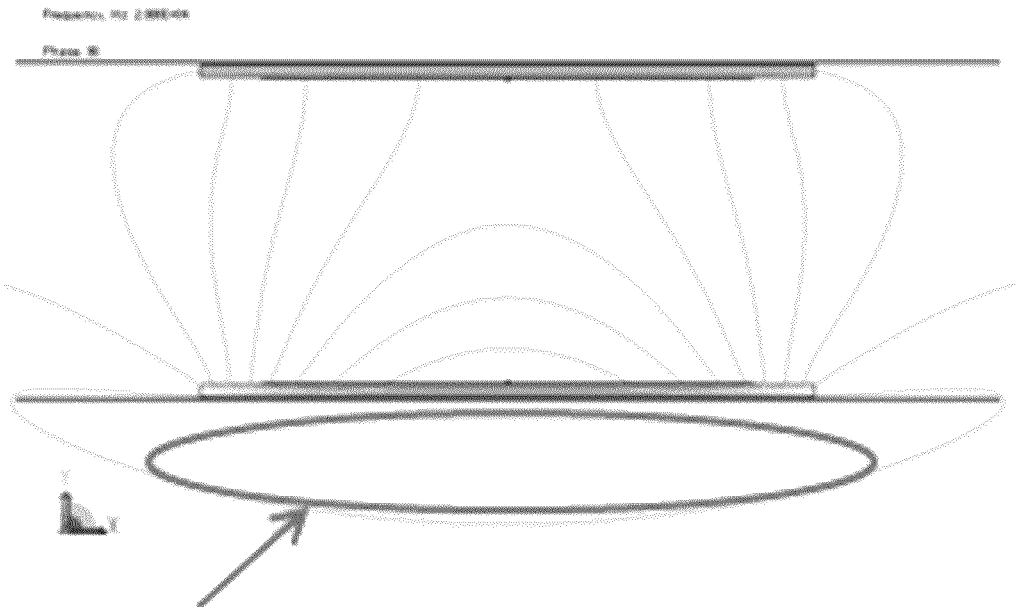
FIG. 6(*a*) illustrates exemplary flux paths, including the reluctance paths and leakage inductances for an exemplary magnetic coupler with a screen.
Figure 6B:
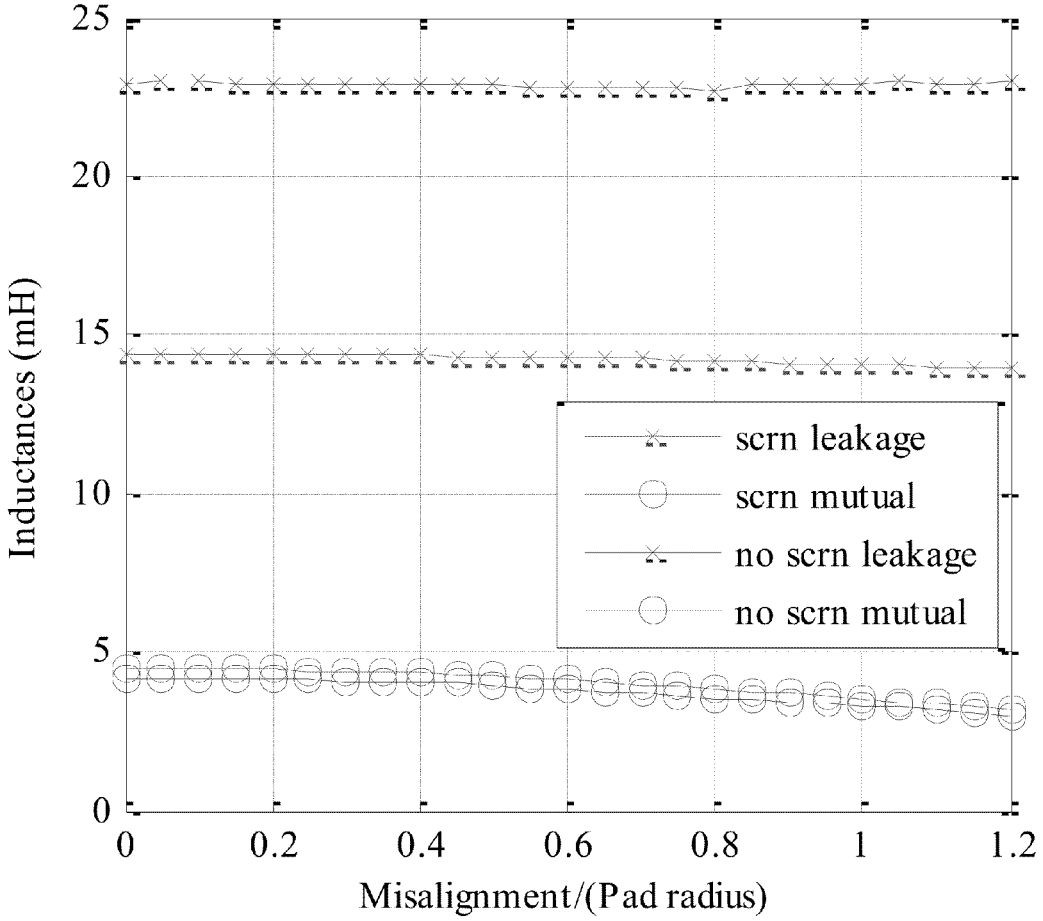

FIG. 6(*a*) illustrates an exemplary pad with a diamagnetic screen and the flux paths associated therewith, with the screen field leakage designated by the oval pointed to by the illustrated arrow. FIG. 6(*b*) illustrates a plot of leakage and mutual inductances. In FIG. 6(*a*), the leakage inductance has been reduced by 39% for a flat pickup as shown in FIG. 6(*b*), and hence a higher coupling coefficient can be obtained. In this example, a superconductor sheet that is 5 mm thick was used to simulate the benefits of a diamagnetic screen. Note that in FIG. 6(*b*) the "no scrn leakage" plot is between 20-25 mH, the "scrn leakage" plot is between 10-15 mH, and the "scrn mutual" and "no scrn mutual" plots are between 0-5 mH.

To power an electrical apparatus via IPT, such as an EV as it moves on a section of electrified roadway, a magnetic coupler with the ability to mutually couple over great misalignments is preferred. As described above, the instant pad not only adopts the concept of guiding magnetic fields via soft ferrimagnetic materials like ferrite, but also blocks unwanted leakage fields using materials that behave as diamagnetic materials (e.g. low loss metal screens.) Because the losses in an IPT system are inversely proportional to the coupling coefficient squared, improving the coupling causes significant loss reduction in the system. C. M. Zierhofer and E. S. Hochmair, "Geometric approach for coupling enhancement of magnetically coupled coils," *IEEE Transactions on Biomedical Engineering*, vol. 43, no. d 7, pp. 708-714, 1996.

In addition, the instant magnetic coupler reduces the variation in the coupling coefficient over wide misalignment conditions by researching magnetic field shaping. This is particularly important in WPT systems. The well-known WPT power equation is:

$$P = \omega I_1^2 \frac{M^2}{L_2} Q_2 = \omega I_1^2 L_1 k^2 Q_2 \qquad \text{(Formula 4)}$$

where ω is the operating angular frequency, $I_1$ is primary track current, $I_2$ is the secondary inductor current, and $Q_2$ is the quality factor of the parallel resonant tank on the secondary. J. T. Boys, G. A. Covic and A. W. Green, "Stability and control of inductively coupled power transfer systems," *IEE Proceedings—Electric Power Applications*, vol. 147, no. 1, pp. 37-43, 2000. This equation depicts the maximum real power that can be transferred in a WPT system without a power decoupling controller. The amount of reactive power stored in the system is largely dependent on the real power (coupling dependent) and also $Q_2$ of the system. Since the reactive power is proportional to the square of the coupling coefficient, any change in coupling coefficient over wide misalignment will cause the system to store squared times more Volt-Amperes (VAs), which significantly reduces system efficiency. For example, for a circular pad operating with misalignments of 46% pad radius, the VAs have to be overrated by 300% (a 100% change in coupling). Compare this to the new pad operating with a misalignment of 100% pad radius, the VA only has to be overrated by 50% (a 24% change in coupling).

The instant method and apparatuses decrease the variation in coupling and keep the mutual inductance relatively constant over wide misalignments. Indeed, certain arrangements of materials, as illustrated in FIG. 5 and described above, that behave diamagnetically have far superior performance in holding coupling coefficient approximately constant over misalignment conditions compared to ferrimagnetic materials alone. At least one purpose of the screen is to reduce or block the excessive leakage flux that would form due to the ferrimagnetic materials alone.

A system of multiple magnetic couplers according to the description above may be provided. Such a system may include two or more magnetic couplers. The pad designs described herein may be applied and used in the wireless power transfer systems and methods described in U.S. Provisional Patent Application No. 61/589,599, filed Jan. 23, 2012, the entirety of which is herein incorporated by reference. For example, a vehicle or other electrical device may be equipped with at least one receiving magnetic coupler which receives a magnetic field from at least one transmitting magnetic coupler. Transmitting magnetic couplers may include, for example, a single station, such as a charging station, or intermittently be positioned along a path of travel, such as a rail, road, transportation route. The distance over which the vehicle is to travel is directly tied to the number of transmitting magnetic couplers needed for the system. In some embodiments, millions of transmitting magnetic couplers would be necessary. In any case, the transmitting magnetic coupler is tied to a power source. The transmitting magnetic coupler emits a magnetic field which is picked up by a receiving magnetic coupler.

The following examples are illustrative only and are not intended to limit the disclosure in any way.

EXAMPLES

Example No. 1

Figure 7:
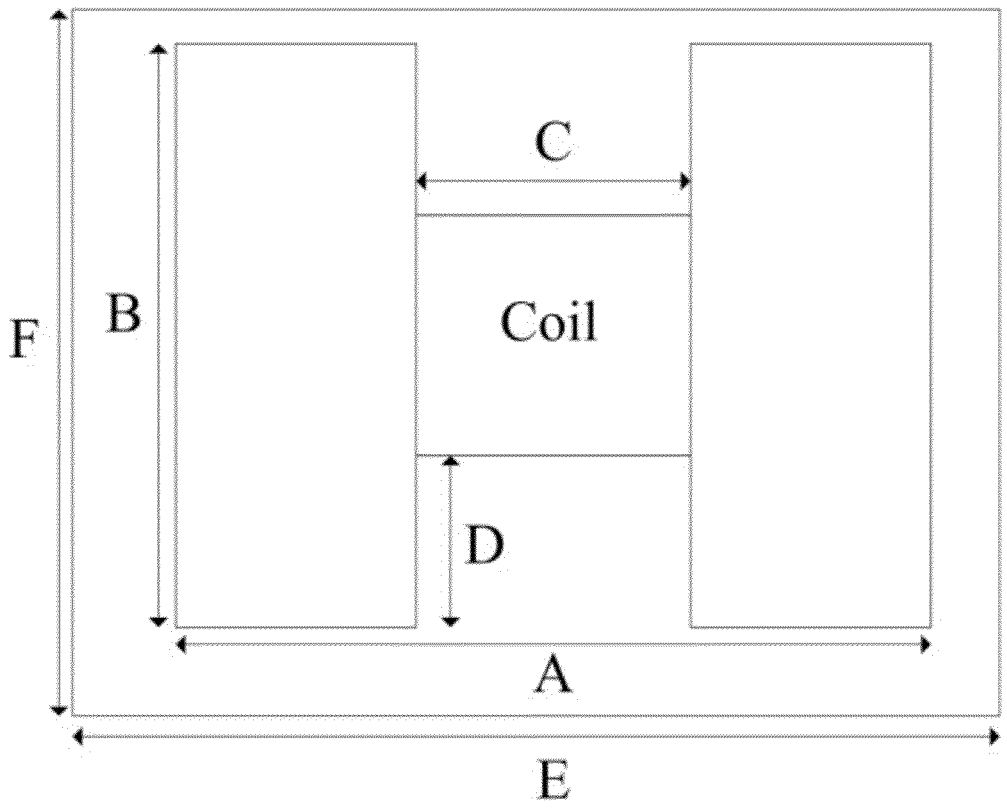
FIG. 7 illustrates an exemplary magnetic coupler with exemplary design parameters.

An exemplary magnetic coupler is designed and compared with a circular pad, as described above. The parameters are illustrated and listed in FIG. 7 and the below table.

| All dimensions in mm | |
|---|---|
| A | 1000 pad length |
| B | 800 pad width |
| C | 600 coil length |
| D | 150 gap width |
| E | 2000 screen length |
| F | 1800 screen width |
| | Ferrite thickness: 20 |
| | Coil Thickness: 20 |
| | No. of Turns: 3 |
| $I_1$ | 100 A at 100 kHz |

As indicated in the table, the number of turns for the pad is 3. These turns are evenly distributed over the middle section of the H-shaped pad. However, the middle section is very long for 3 radial turn of wires; as such, a practical equivalent of such turns could employ multi-filiar winding where many turns would be connected in parallel to simulate the 1 complete turn. In this case, a hexa-filiar wound coil may be used with a total winding of 18 turns, but is electrically equivalent to 3.

Figure 8:
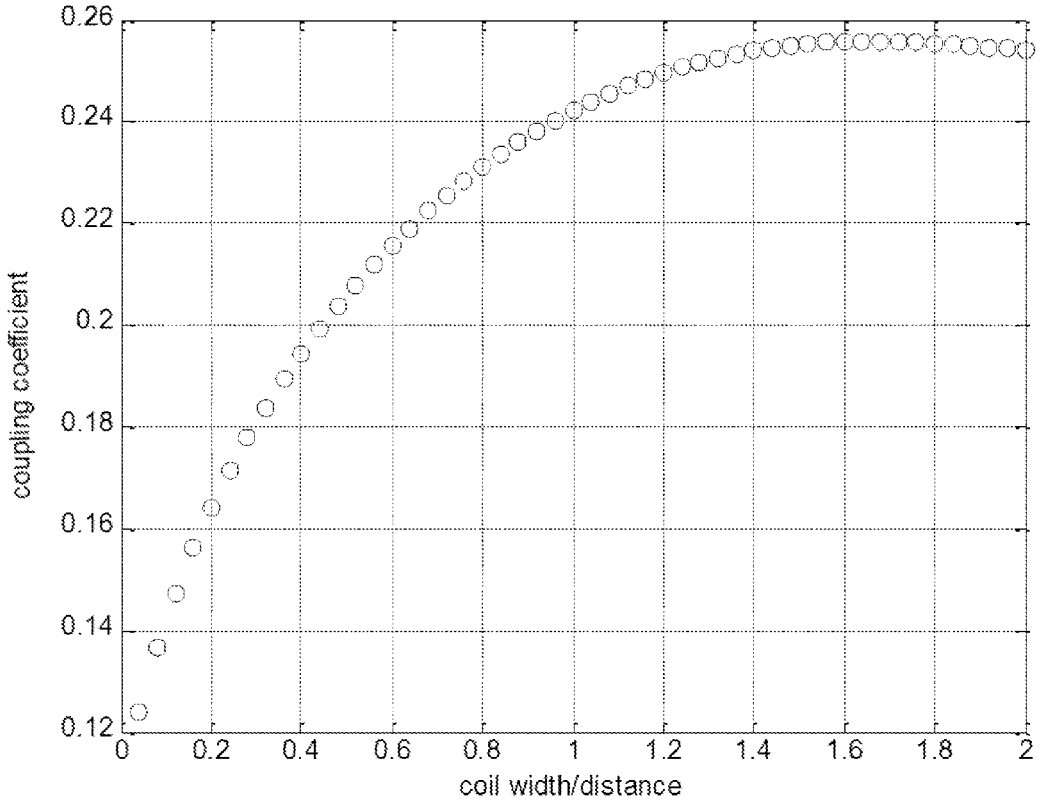
FIG. 8 is an illustrative graph of the coupling coefficient (y-axis) against a coil width to distance ratio (x-axis).

In this example, the pickup length is twice the distance or air gap. It can be seen from FIG. 8 that the optimal coupling is achieved when the coil length is nearly two times the distance or the length of ferrite of the flat pickup. However, the optimal is about 80% of the pickup length rather than the full length.

Figure 9:
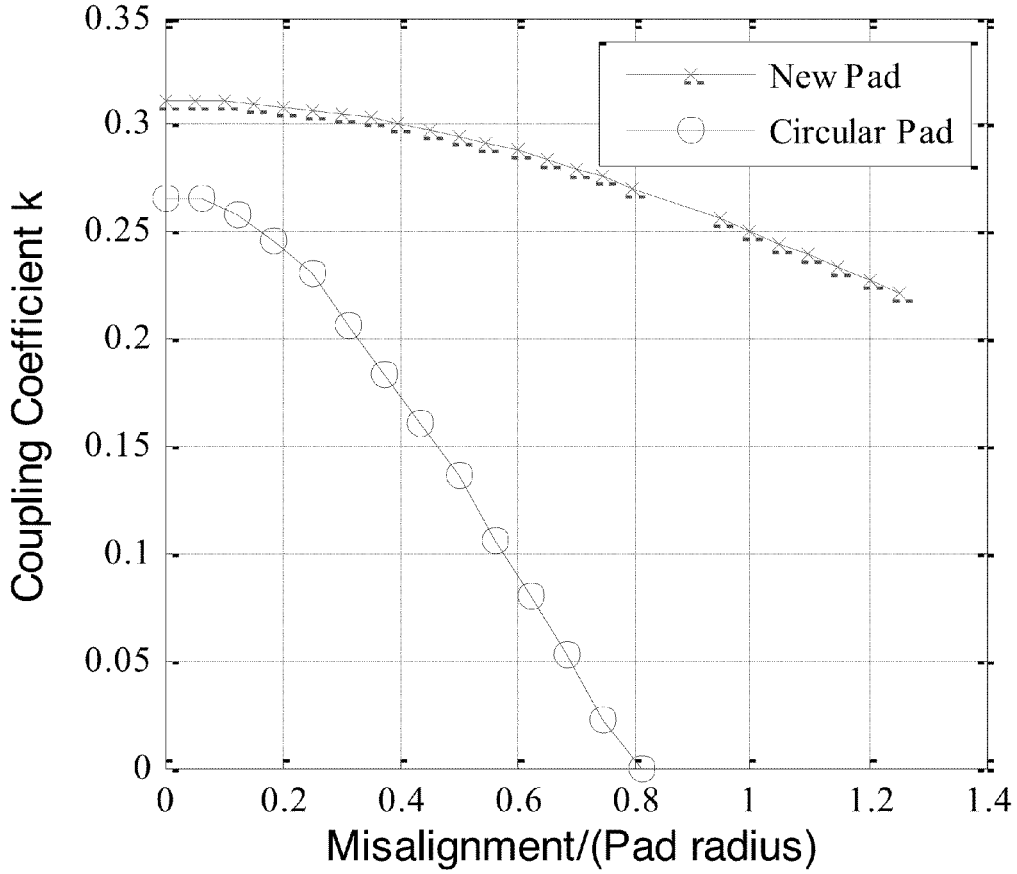
FIG. 9 is an illustrative graph of coupling coefficients for a circular pad and an exemplary new pad (y-axis) against horizontal misalignment of the transmitter and receiver (x-axis).
Figure 10:
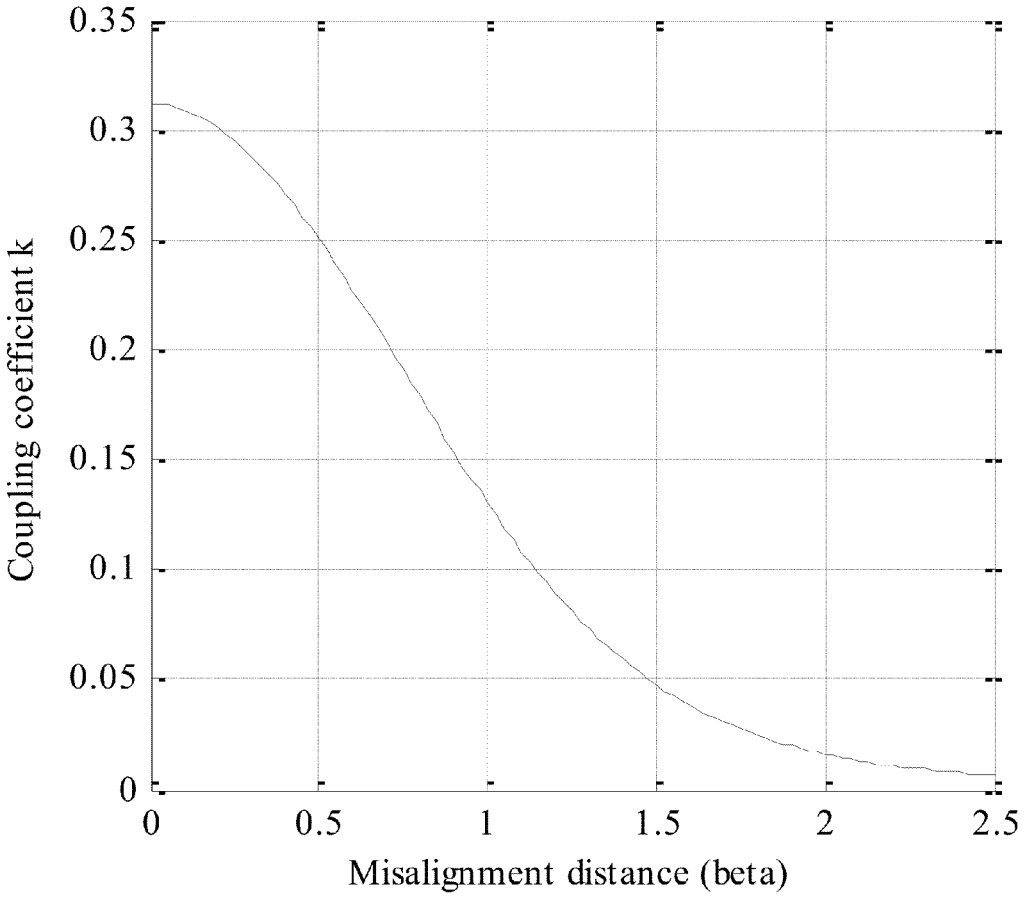
FIG. 10 is an illustrative graph of the coupling coefficient (y-axis) against the misalignment distance (x-axis).

When compared with the circular pad described earlier, the instant pad maintains a much higher coupling coefficient, as illustrated in FIG. 9. In addition, FIG. 10 illustrates that the coupling coefficient changes slowly as the horizontal misalignment is increased. Beta is defined as the normalized distance of the misalignment over the whole pad length.

Figure 11:
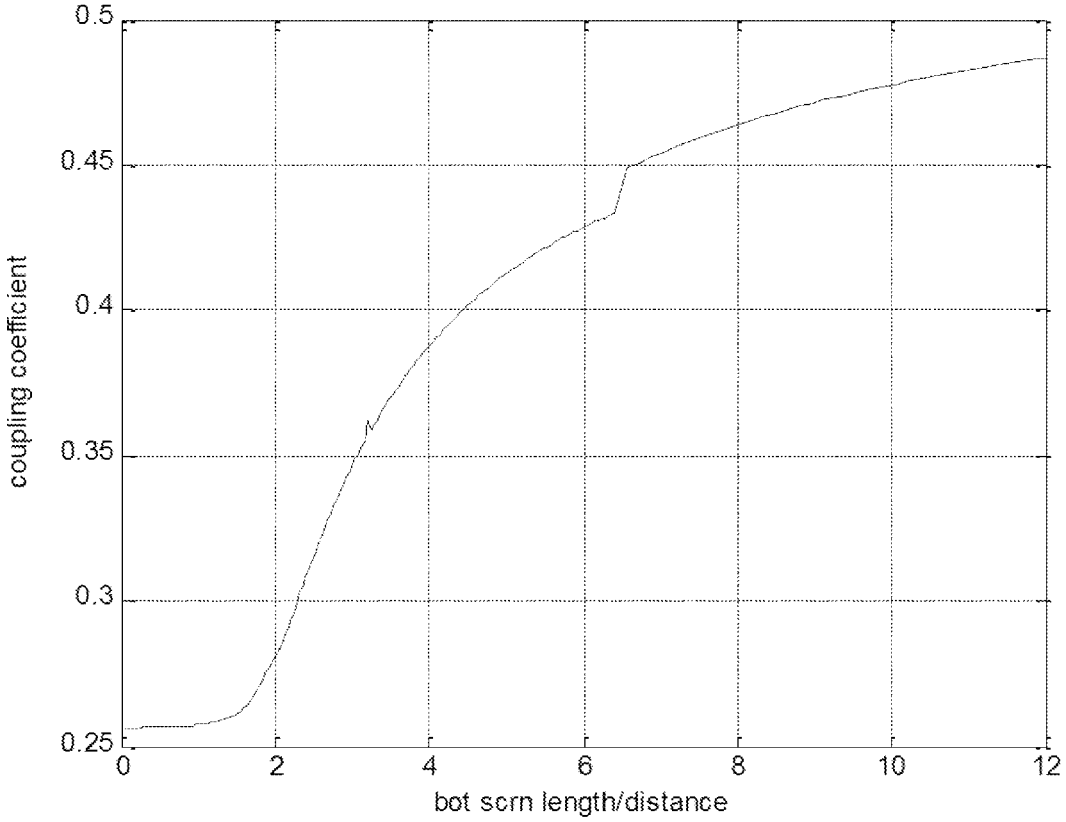
FIG. 11 is an illustrative graph of the coupling coefficient (y-axis) against the length of a bottom screen (x-axis).

To further illustrate the effectiveness of screening, a simulation of a flat pickup is built. The simulation of coupling coefficient and the length of the bottom screen are plotted in FIG. 11. It can be seen that the coupling increases asymptotically as the bottom screen increases in dimension against the air gap. The sharp transition in the simulation results is due to a change in mesh size as a larger simulation boundary condition was required at bigger screen size, hence the mesh size was doubled to keep the number of elements for computation within reasonable limits. The mutual inductance decreases slightly initially and then increases, but the change is quite small. However, the self-inductance continues to decrease as the screen blocks the path of any leakage flux.

Figure 12:
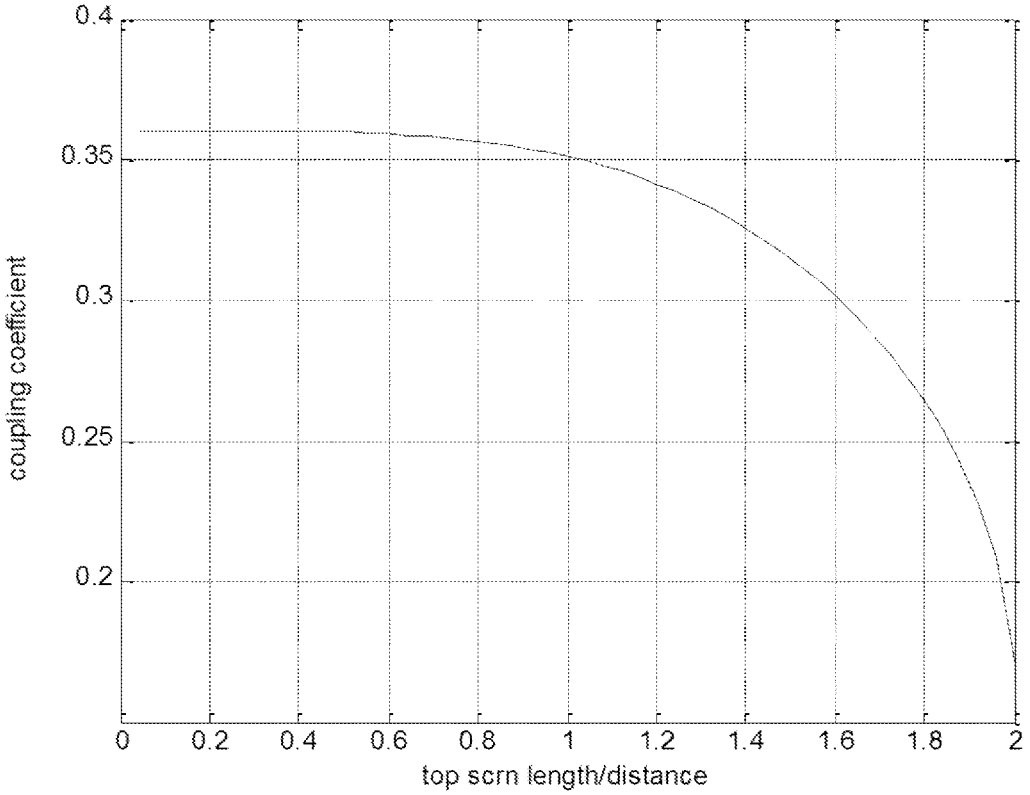
FIG. 12 is an illustrative graph of the coupling coefficient (y-axis) against the length of a top screen (x-axis).

A top-side screen was also added to the simulation and the results are shown in FIG. 12. Here, the bottom screen is set to 80% of the pickup length. It can be seen that the coupling continuously decreases as the dimensions of the top screen are increased. The mutual inductance continuously decreases because there is less area or path to allow the flux to link the two coils, hence the reluctance of the mutual flux link increases. The self-inductance continuously decreases as well as leakage flux is also reduced. However, the rate of decrease for the mutual increase is always greater than for leakage hence placing a top screen actually degrades the system performance.

Example No. 2

Metamaterials may be made with a resonant coil/ring structure on PCB's. At high frequencies, the ring's inductance may be made to resonate with its own parasitic capacitance which will be at the resonant frequency. At lower frequencies, this result may be more difficult to achieve; however, the metamaterials may be made by adding an external resonant capacitor with an inductive coil to form this resonant structure.

Figure 13:
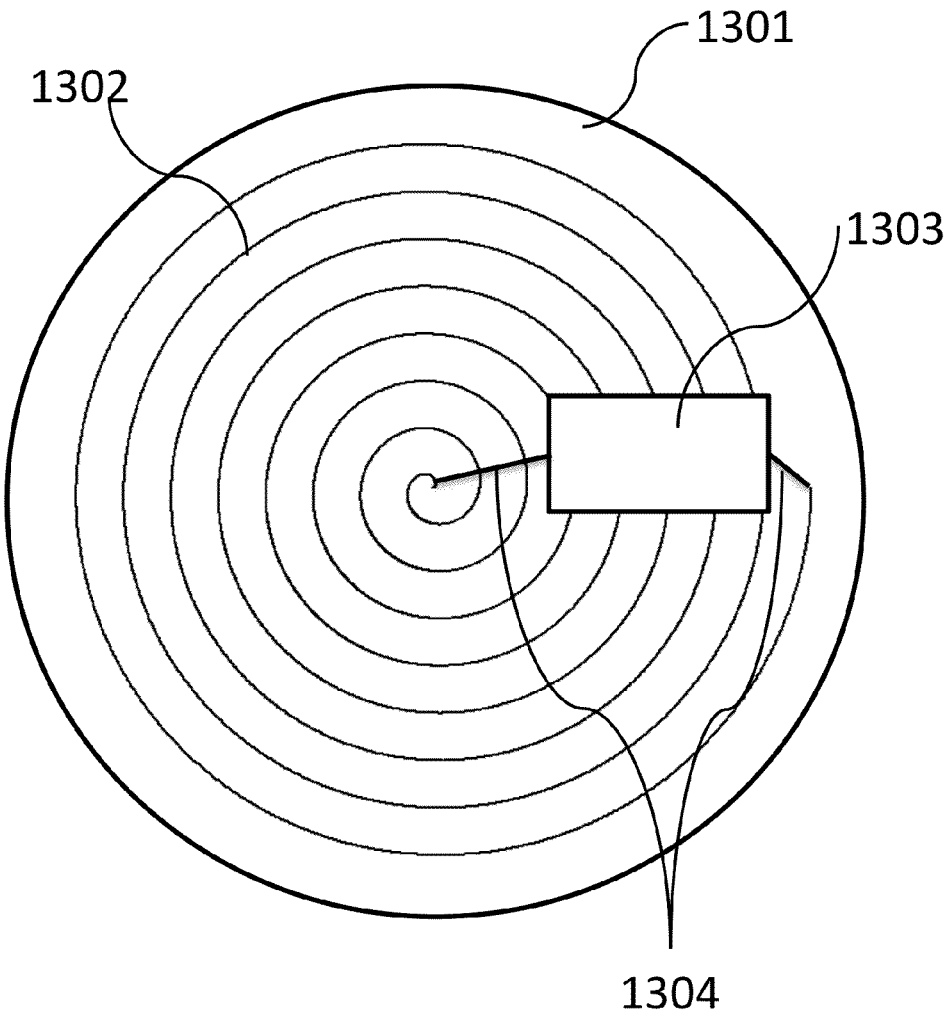
FIG. 13 illustrates an exemplary designed metamaterial made on PCB.

FIG. 13 illustrates an exemplary PCB milled metamaterial including a pcb 1301, a conductive coil 1302, and a capacitor 1303 connected to both ends of the coil by connectors 1304. In this example, the coil inductance is 13 uH, and capacitance is 528 nF, and fs=60 kHz. To quantify the performance of the metamaterial, impedance and phase angle measurements were made using a precision LCR meter (E4950).

With the exemplary metamaterial, the primary excitation inductor coil was turned into a pure resistor and a poor capacitor. For the impedance measurement of the LCR meter, we first measure the primary coil characteristics only:

$$R_{coil}+jX_{coil}=Z\cos(\theta)+jZ\sin(\theta) \quad \text{(Formula 5)}$$

The difference between the reactance and relative permeabilities may be calculated by:

$$\tan(\delta)=\frac{R_{meta}}{X_{meta}}=\frac{\mu''}{\mu'} \quad \text{(Formula 6)}$$

To determine the actual u', an reference inductance measurement must be made. Using this as the base reactance, the relative permeability can be calculated by:

$$\mu'=\frac{L_{meta}+L_{coil}}{(L_{meta}+L_{coil})@200\text{ Hz}} \quad \text{(Formula 7)}$$

Figure 14:
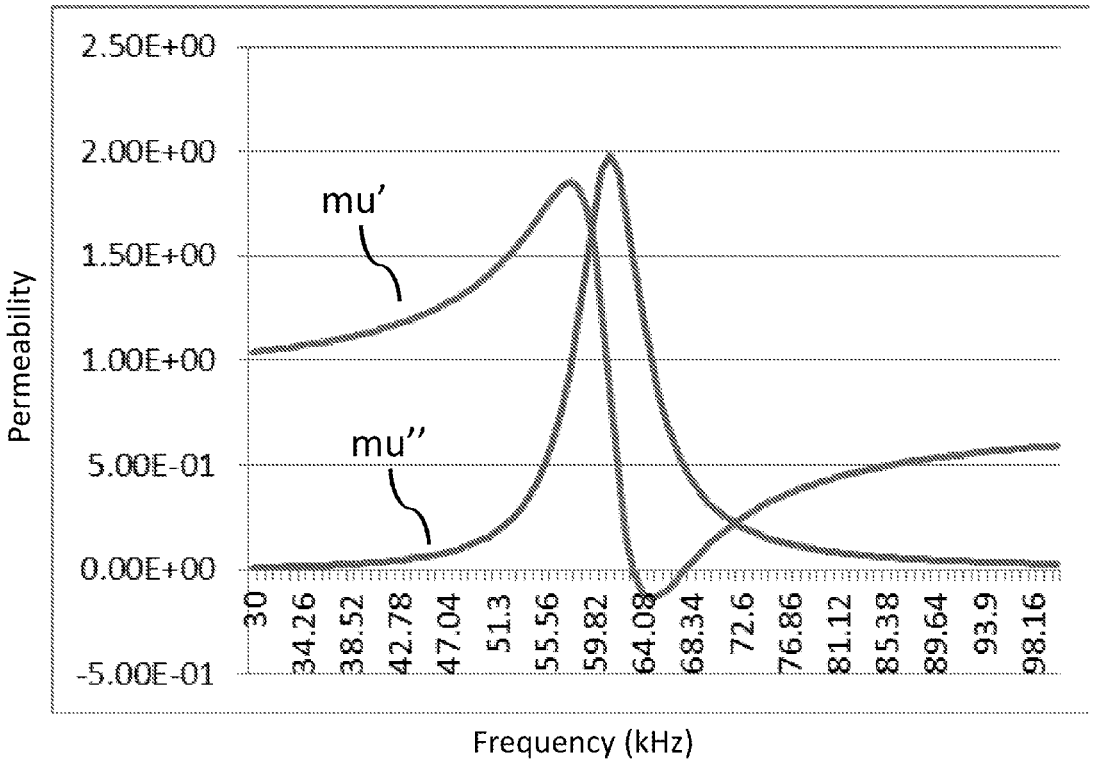
FIG. 14 illustrates the relative permeability ($\mu'$ and $\mu''$) of an exemplary metamaterial.
Figure 15:
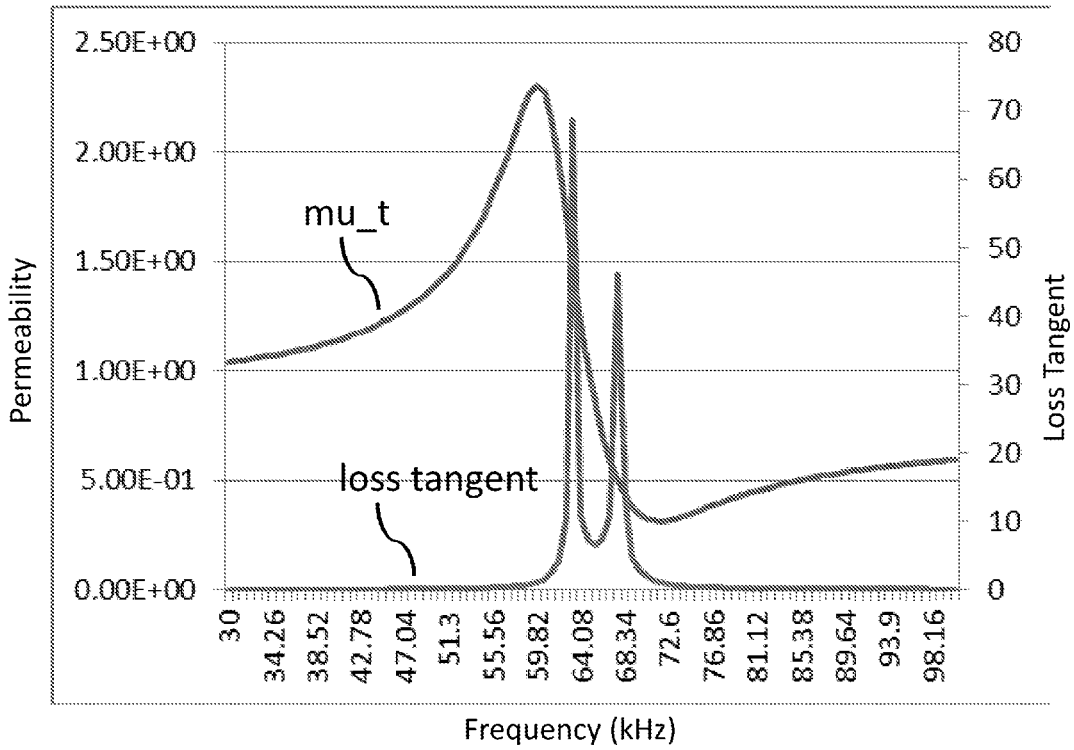
FIG. 15 illustrates the total permeability and the loss tangent of an exemplary metamaterial

$L_{coil}$ is included minimize the error due to measurement. From this, u" can also be determined. The results and measured data are shown in FIGS. 14 and 15. As can be seen, the material follows the standard Lorenztian distribution which is typical for metamaterials. This data illustrates the shielding ability of a metamaterial of the same or similar design.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A magnetic coupler, comprising:

a ferrimagnetic component capable of guiding a magnetic field, a wire coil wrapped around at least a portion of the ferrimagnetic component, and a screen capable of blocking leakage magnetic fields, the screen positioned to cover at least one side of the ferrimagnetic component and the coil, wherein the screen comprises a metamaterial, the metamaterial comprising printed circuit board ("PCB") coils, the PCB coils comprising at least one full turn.

2. The magnetic coupler of claim 1, wherein the ferrimagnetic component is selected from the group consisting of ferrite, soft ferrite, manganese-zinc ferrite, and nickel-zinc ferrite.

3. The magnetic coupler of claim 1, wherein the ferrimagnetic component is configured to generate a horizontal field.

4. The magnetic coupler of claim 1, wherein the ferrimagnetic component is configured in an H-shape.

5. The magnetic coupler of claim 1, wherein the coil is wrapped around a center portion of an H-shaped ferrimagnetic component.

6. The magnetic coupler of claim 1, wherein the coil is capable of carrying alternating current.

7. The magnetic coupler of claim 1, wherein the screen comprises a material selected from the group consisting of a superconductive material, a metamaterial, a superconductive metamaterial, an actively excited circuit, and a diamagnetic material.

8. The magnetic coupler of claim 1, wherein the screen comprises metamaterial.

9. The magnetic coupler of claim 1, wherein the screen comprises a diamagnetic material.

10. A wireless power transfer system, comprising:

a transmitting magnetic coupler, a receiving magnetic coupler, wherein the transmitting magnetic coupler and the receiving magnetic coupler each comprise:

a ferrimagnetic component capable of guiding a magnetic field, a wire coil wrapped around at least a portion of the ferrimagnetic component, and a screen capable of blocking leakage magnetic fields, the screen positioned to cover at least one side of the ferrimagnetic component and the coil, wherein the screen comprises a metamaterial, the metamaterial comprising printed circuit board ("PCB") coils, the PCB coils comprising at least one full turn.

* * * * *